United States Patent [19]

Greenberg

[11] 4,353,701

[45] Oct. 12, 1982

[54] EDUCATIONAL, ACTION-TYPE, AMUSEMENT CENTER TOY

[75] Inventor: Sheldon Greenberg, New York, N.Y.

[73] Assignee: Shelcore, Inc., New York, N.Y.

[21] Appl. No.: 211,652

[22] Filed: Dec. 1, 1980

[51] Int. Cl.[3] ..... A63H 33/00

[52] U.S. Cl. ..... 434/259; 46/1 A; 46/146

[58] Field of Search ..... 46/1 A, 145, 146; 434/259

[56] References Cited

U.S. PATENT DOCUMENTS 2,646,646 7/1953 Glass ..... 46/1 A X 2,774,179 12/1956 Zalkind ..... 46/1 A X 2,911,740 11/1959 Miller ..... 434/259

4,237,650 12/1980 Goldfarb ..... 434/259 X

*Primary Examiner*—F. Barry Shay

*Attorney, Agent, or Firm*—Kirschstein, Kirschstein, Ottinger & Cobrin

[57] ABSTRACT

An educational, action-type amusement center toy for children comprises a set of three pop-up members mounted on a housing, each pop-up member being movable from a hidden position to a display position. Each pop-up member is actuated by a different plurality of actuators in response to different manual actions performed by the child.

33 Claims, 8 Drawing Figures

FIG. 6
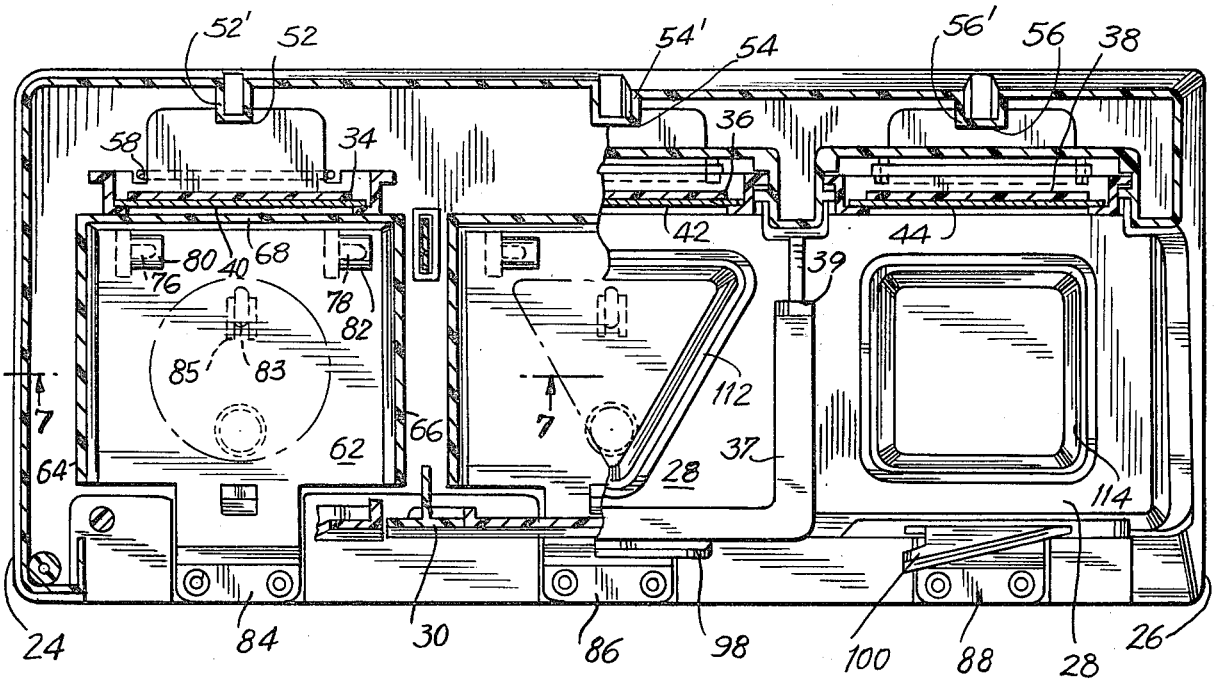
FIG. 7
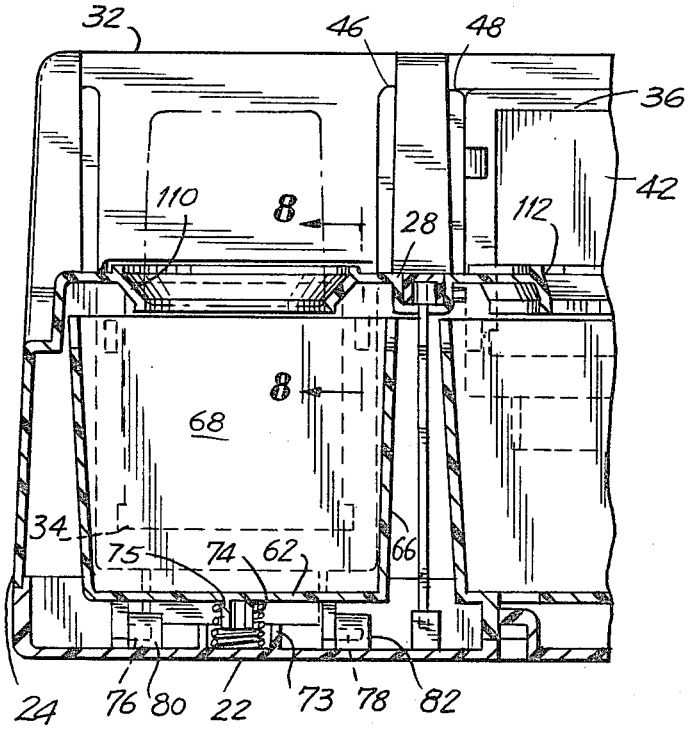
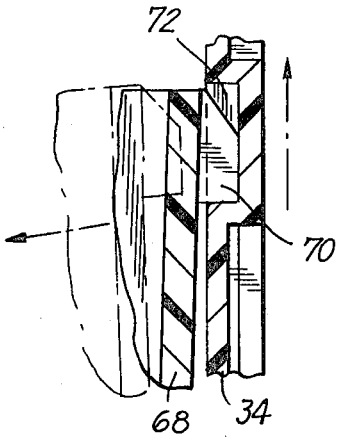
FIG. 8

EDUCATIONAL, ACTION-TYPE, AMUSEMENT CENTER TOY

BACKGROUND OF THE INVENTION

1. Field of the Invention

The present invention generally relates to action-type toys for children and, more particularly, to an educational, action-type, amusement center toy for children.

2. Description of the Prior Art

Jack-in-the-box-type toys are already known in the art. Jack-in-the-boxes provide a child with only a single mechanism for suddenly moving a doll-like portion of the toy from a hidden position to a visible position with great force. This single mechanism for moving the doll-like portion of the toy generally consists of a crank which the child turns to unlatch a latch.

Also known in the prior art are shape-box-type toys, wherein three-dimensional blocks of different shapes are inserted through correspondingly-shaped openings. Shape-boxes educate children to learn different geometrical shapes and also help them develop their gross motor skills.

Although these aforementioned toys have proven generally satisfactory for the limited purposes of amusing a child for relatively short periods of time and for aiding the development of gross motor skills, they have not proven to be altogether satisfactory for providing amusement over relatively long time periods, nor have they aided the development of fine motor skills.

Further, the aforementioned toys have not utilized the widely-accepted educational concept of providing an immediate reward to a child who successfully manually performs a task. Nor have the prior art toys proven to be sufficiently intellectually stimulating so that the child becomes bored in a relatively short time.

Additionally, the prior art toys do not aid the child in developing memory skills. They do not train the child to make a mental connection between something that they can see and something that is hidden from view.

SUMMARY OF THE INVENTION

1. Objects of the Invention

Accordingly, it is an object of the invention to provide an educational, action-type amusement center toy for children, which avoids the disadvantages of the prior art toys.

It is another object of the invention to amuse a child for extended periods of time without boring him.

It is still another object of the invention to provide an immediate reward to a child who successfully performs a manual task.

It is yet another object of the invention to help a child develop his hand-eye coordination and motor skills.

Another object of the invention is to provide a safe educational toy which contains no parts with which a child can harm himself or others.

Still another object of the invention is to provide a relatively inexpensive educational toy.

Yet another object of the invention is to provide a durable educational toy of the character described which a child cannot easily damage.

It is still another object of the invention to aid a child to develop memory skills.

Other objects of the invention in part will be obvious and in part will be pointed out hereinafter.

2. Features of the Invention

In keeping with these objects, and others which will become apparent hereinafter, one feature of the invention resides, briefly stated, in an educational, action-type amusement center toy for children which contains a plurality of different manually-manipulated actuator means, any one of which will cause a hidden pop-up member to move to a display position when correctly manipulated by a child.

In a preferred embodiment, the educational, action-type amusement center toy has three, separate, movable, pop-up members each actuated by a separate plurality of three different actuator means. The pop-up members have different, fancifully-arranged displays thereon.

Each plurality of actuator means preferably consists of: a manually-depressable release extension; a manually-openable release door; and a propellable release weight. The amusement center toy is contained in a light-weight, portable housing which also has a handle thereon so that the toy can be transported from place to place.

As noted above, in its preferred embodiment, the amusement center toy contains three pop-up members, each with three different actuator means, thereby resulting in nine separate and distinct tasks for a child to manually perform. At his option, the child may manually depress any one of three release extensions, or may manually open any one of three release doors, or propel any one of three release weights. Any one of the above manual actions will unlatch a pop-up member and cause the same to pop-up to its display position.

Thus, the amusement center toy greatly increases the play value and entertainment appeal for children and also increases the amount of intellectual stimulation given the children, because it provides the child with numerous different chores to perform. Each chore, when performed correctly, will provide the child with a reward, i.e., the display of a fanciful figure on one of the pop-up members.

Further, in accordance with another feature of the invention, each release door is provided with a small doorknob portion. The door and its associated doorknob, due to their miniature size, provide a means for children to develop their fine motor skills.

Another feature of the invention resides in the fact that, in the preferred embodiment, the housing is formed with cutouts which have three different shapes that correspond to the shapes of the three separate release weights, and they, in turn, correspond also to the shapes of the three doorknobs. In order to cause a pop-up member to move to its display position, a child must learn which shapes are the same. More particularly, the child must match the shapes of the release weights to that of the cutouts to unlatch the pop-up members, and thereupon match the shapes of the doorknobs to that of the release weights to retrieve the latter. In this way, the amusement center toy provides the child with a valuable educational experience and develops his memory skills.

Another feature of this inventions resides in the fact that, in the preferred embodiment, three separate and distinctive, appealable, fanciful pictures are hidden from the child's view until the child activates one of the actuator means. In this way, a child learns to make a mental connection between each hidden picture and the actuator means that will cause each particular picture to come into view, i.e., the child learns to remember which means causes the display of which pictures.

A safety feature of the invention is embodied in shielding the pop-up member during its rapid travel to its display position. This overcomes the safety problem of Jack-in-the-box-type toys which have unshielded doll-like portions, which have been known to injure children due to their considerable pop-up force.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is a partially broken-away top plan view of the toy of FIG. 1;

FIG. 7 is a partially broken-away sectional view of the toy of FIG. 1 taken along line 7—7 of FIG. 6; and FIG. 8 is an enlarged sectional view of the latching element taken along line 8—8 of FIG. 7.

DETAILED DESCRIPTION OF THE PREFERRED EMBODIMENT

Figure 1:
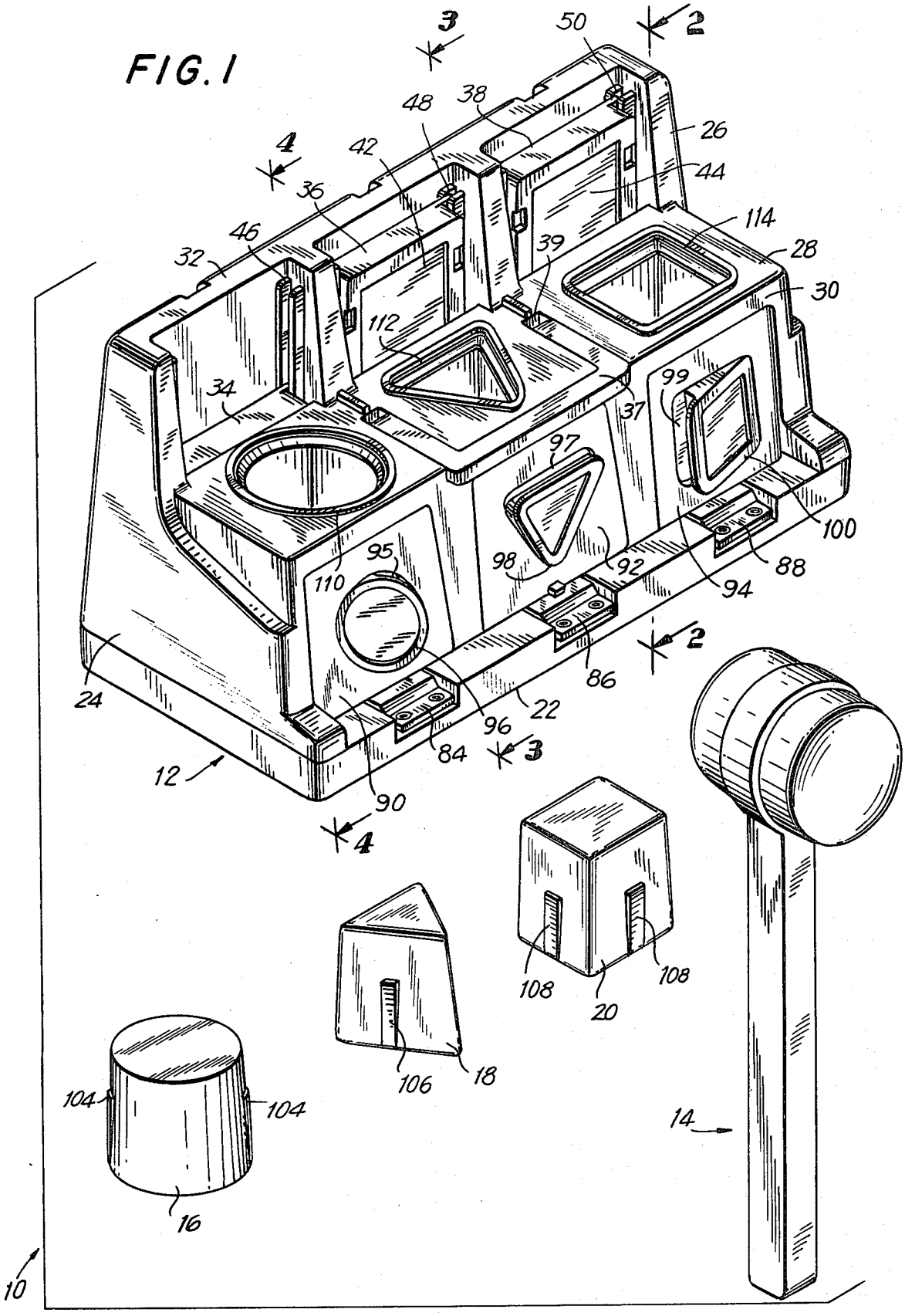
FIG. 1 is a perspective view of the educational, action-type amusement center toy for children in accordance with this invention.

Referring now to the drawings and, more particularly, to FIG. 1 thereof, reference numeral 10 generally identifies the educational, action-type, amusement center toy for children in accordance with this invention. The toy 10 comprises a housing 12, a striker means or hammer 14, and a set of three release weights or three-dimensional toy blocks 16, 18, 20.

The housing 12 is a light-weight, plastic, self-supporting structure having a base 22 adapted for supporting the housing on a flat surface such as a table top; a pair of upright generally L-shaped side walls 24, 26 at opposite sides of the base; an overhead housing portion 28 which overlies the base 22 in generally horizontal orientation; an upright front wall portion 30 extending generally perpendicularly between the base 22 and the overhead portion 28; an upright rear shield wall portion 32 extending generally perpendicularly upwardly of the base 22 for a predetermined distance above the overhead portion 28; and a handle portion 37 for transporting the toy from place to place. The handle portion 37 is pivotally mounted on the overhead portion 28 for movement between a storage position (FIG. 1) in which the handle portion 37 is received in a U-shaped groove 39 formed in the housing; and a carrying position 37' (FIG. 3) in which the child can carry the housing by gripping the handle portion 37.

A set of three pop-up members 34, 36, 38 are mounted on the housing 12, closely adjacent to the rear wall portion 32. Each pop-up member 34, 36, 38 has an associated display means 40, 42, 44. The display means is a lightweight-cardboard sheet on which is applied any picture that would appeal to a child. In its preferred embodiment, the display means contain fancifully-arranged, brightly-colored pictures of animals.

The pop-up members 34, 36, 38 and their associated display means 40, 42, 44 are respectively jointly mounted on pairs of spaced-apart tracks 46, 48, 50. The tracks, molded into the housing 12, are generally upwardly extending. The pop-up members 34, 36, 38 have side portions that are mounted within the spaces defined between each track pair for reciprocal sliding up-and-down movement along the tracks.

The pop-up members 34, 36, 38 slide along the tracks 46, 48, 50 between two end-limiting positions: a hidden or latched position, in which the pop-up member and its associated display are hidden from the child's view behind the front wall portion 30 of the housing 12; and a display or unlatched position, in which the pop-up member and its associated display are visible to the child and are positioned directly in front of, and slightly below, the upper part of the rear wall portion 32 of the housing 12. The two end-limiting positions are illustrated in FIG. 1, wherein pop-up member 34 and its associated display 40 are depicted in the hidden position, and pop-up members 36 and 38 with their associated displays 42 and 44 are depicted in their display positions. As best seen in FIG. 6, the pop-up members 34, 36, 38 have guide grooves 52, 54, 56 formed at their rear which receive in sliding engagement corresponding guide ribs 52', 54', 56', that are formed on the rear wall 32 of the housing. The grooves and ribs constitute guide means for guiding the pop-up members in their sliding movement along the tracks 46, 48, 50.

Figure 4:
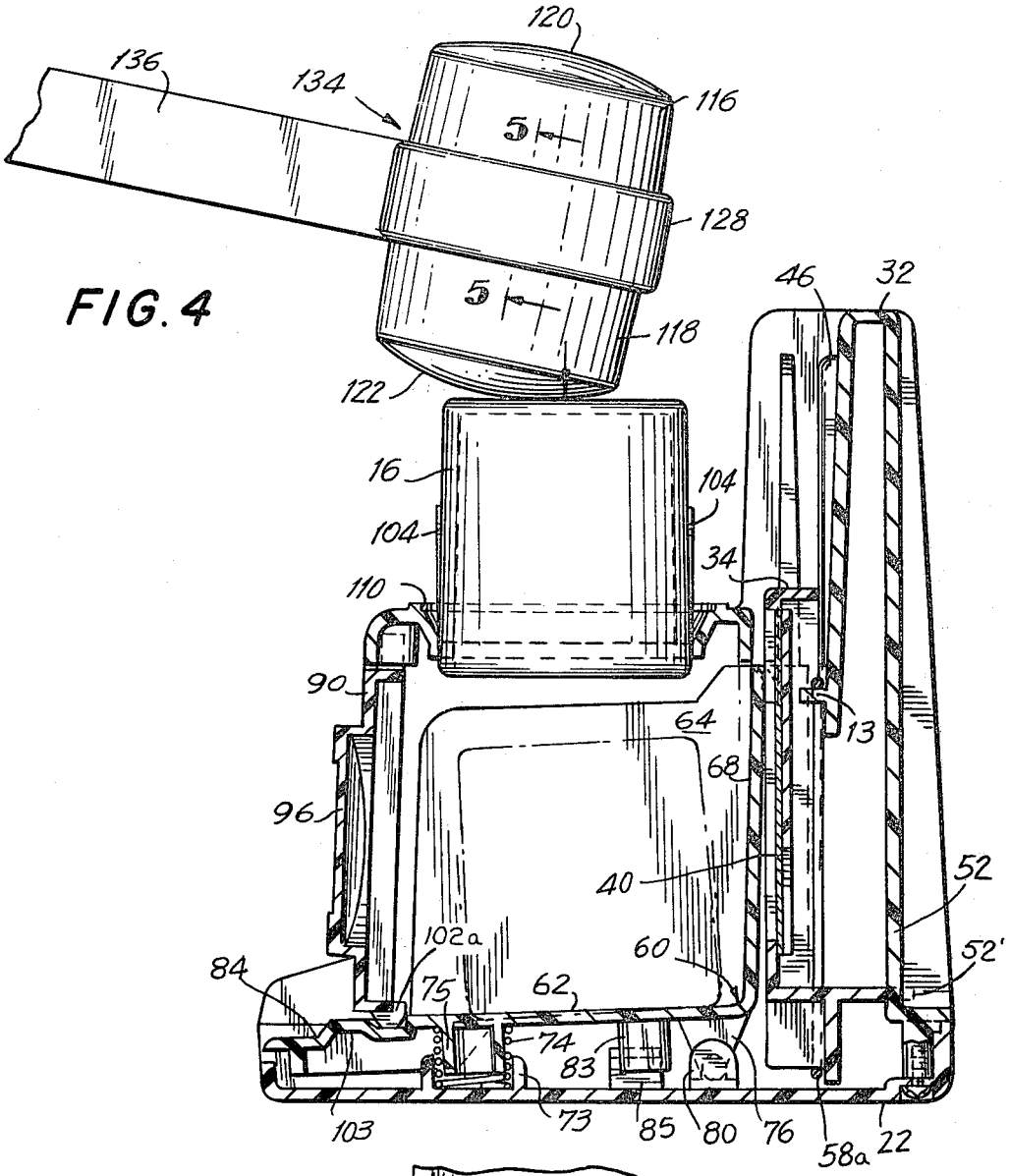
FIG. 4 is a cross-sectional view taken along line 4—4 of FIG. 1, showing the operation of a third actuator means.

As best seen in FIG. 4, biasing means, such as an elastomeric rubber band **58*a*, is looped about the housing and pop-up member 34. One looped end of band 58*a* is mounted on the housing 12 about projection 13, and its other looped end is mounted on the pop-up member 34 at its lower end. The band 58*a* has a predetermined biasing force which constantly urges the pop-up member 34 in an upward direction from its hidden position towards its display position. The elastomeric band 58*a* is stretchable between a stressed condition (FIG. 4) and a relaxed condition (FIG. 2) when the pop-up member 34** is in its hidden and display positions, respectively.

Each pop-up member is provided with its own biasing means; however, for the sake of brevity, only the biasing means for representative pop-up member 34 has been described. It will be understood that pop-up members 36, 38 have identical biasing means **58*b*, 58*c***.

Figure 2:
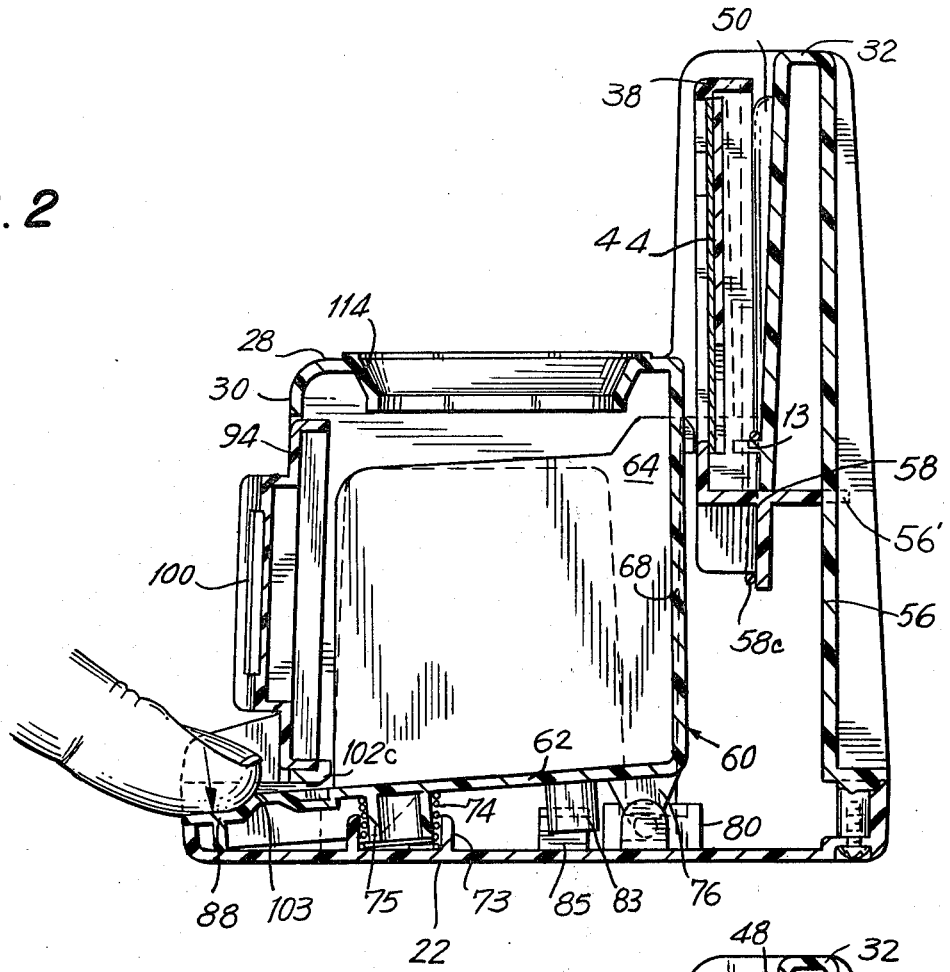
FIG. 2 is a cross-sectional view taken along line 2—2 of the toy of FIG. 1, showing the operation of one actuator means.
Figure 3:
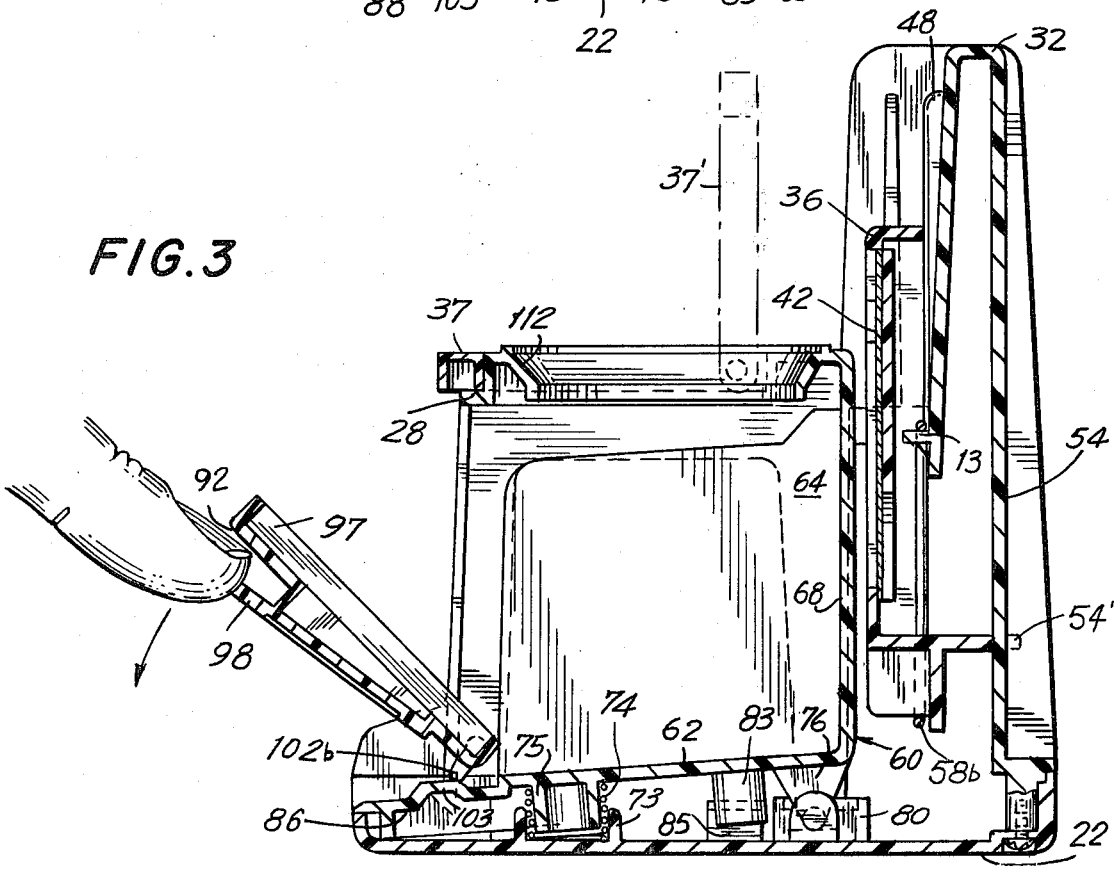
FIG. 3 is a cross-sectional view taken along line 3—3 of FIG. 1, showing the operation of a second actuator means.

As best seen in FIGS. 2–4, a generally cup-shaped plastic common actuator member 60 is pivotally mounted on the housing 12 for displacement transversely of the up-and-down path of movement of the pop-up members. Each pop-up member has its own common actuator member, but since all of the common actuator members are identical, only the actuator member for pop-up member 34 will be detailed herein.

The common actuator member 60 has a generally rectangular base wall 62, two upright side walls 64, 66 which extend upwardly from two opposite edges of the base wall, and an upright back wall 68 which extends upwardly of the third edge of the base wall. The back wall 68 is juxtaposed with the pop-up member 34 when the latter is in the hidden position.

As best shown in FIG. 8, the amusement toy has a latching means comprising a pair of tapered, latching elements or projections 70 on opposite sides of the back wall 68 of the common actuator member 60. The latching projections 70 are dimensioned and shaped to be received with latching engagement within a corresponding pair of latching recesses 72 formed on opposite sides of the pop-up member 34. Each latching element 70 is tapered to facilitate its withdrawal from the latching recess 72, as described below.

The latching elements 70 are mounted on the common actuator 60 for displacement transversely of the up-and-down path of the pop-up member 34 between a latched position in which the latching elements 70 extend into said path to retain said pop-up member 34 in its hidden position, and an unlatched position in which the latching elements 60 are located remotely from said path to unlatch the pop-up member 34. More particularly, the latching elements 70 extend into and latchingly engage the recesses 72 in the latched position. This latching engagement generates a latching force having a magnitude that is greater than the aforementioned biasing force of the band 58, thereby serving to retain the pop-up member 34 in its hidden position. In the unlatched condition, the latching elements 70 are withdrawn from the recesses 72, and permit the band 58 to relax, and concomitantly, permit the pop-up member to be suddenly and rapidly moved to its display position under the influence of the biasing force.

The common actuator member 60 is pivotally mounted on the base portion 22 of the housing 12 for turning movement about a pivot axis. An elongated coil spring 74 is interposed between the base wall 62 of the common actuator member 60 and the base portion 22 of the housing. More particularly, one end of the spring 74 is received in a well 73 formed in the base portion 22, and the opposite end of the spring is mounted in a tubular projection 75 extending downwardly from the base wall 62. The spring 74 constantly urges the common actuator member 60 in a predetermined circumferential direction, i.e. clockwise, about the pivot axis as viewed in FIGS. 2–4.

The common actuator member 60 has two trunions or stub shafts 76, 78 mounted underneath its base wall 62. The trunions 76, 78 are journaled in corresponding bearings 80, 82 on the base portion 22 of the housing 12, thus providing the aforementioned pivot mounting and defining the pivot axis.

The common actuator member 60 has mounted to the underside of its base wall 62 a non-displacement means or rectangular finger 83 which is shaped and proportioned to fit between a space formed between a pair of stop portions 85 which extend upwardly from the upper side of the housing base wall 22. The non-displacement means 83 and its associated stop portions 85 prevent unauthorized axial displacement of the common actuator member 60 when the finger 83 is captured between the pair of stop portions 85.

Each pop-up member 34, 36, 38 contains a plurality of different actuator means, each of which is operatively connected to the latching elements 70 for displacing the latching elements from their latched position to their unlatched position in order to effect the pop-up action.

One of the actuator means for each pop-up member is a manually-depressable release extension 84, 86, 88. As mentioned earlier herein, as all three pop-up members operate in the same manner, for the sake of brevity, only one of the plurality of actuator means, i.e. the one associated with pop-up member 38, will be detailed herein. The release extension 88 extends radially from the fourth edge of the base wall 62 of the common actuator member 60, and is preferably of one-piece molded plastic construction therewith. When a downward force is applied to the release extension 88, the release extension moves the common actuator member 60 in a reverse circumferential direction about the pivot axis, i.e., counterclockwise in direction opposite to the aforementioned predetermined clockwise direction. When the common actuator member 60 is moved in said opposite circumferential direction against the tension force of spring 74, this action causes the latching elements 70 to move to their unlatched position, thereby enabling the biasing means 58 to move to its relaxed condition. When the biasing means 58 moves to its relaxed condition, this action causes the pop-up member 38 with its associated display 44 to rapidly move upwardly along its associated pair of tracks 50 into its display position. In this manner, a child who successfully manually pushes downward on the release extension 88, as shown in FIG. 2, is rewarded by the popping up of the display 44 on which is depicted an appealable, brightly-colored, fanciful figure. Upon release of the extension 88, the spring 74 returns the common actuator member 60 to its original position.

In the preferred embodiment, as noted above, there are three different pop-up members. Also, as noted above, there are three different release extensions. Although for brevity, the construction and mode of action of only one pop-up member of the invention has been detailed herein, it is important to bear in mind that more than one pop-up member exists. Hence, a child must learn which release extension causes the display of which fanciful figure. In this manner, the child is rewarded for making a mental connection between a specific release extension and a specific picture. Thus, the child's memory skills are trained, utilizing the concept of rewarding the child for a successfully-performed task.

Another of said plurality of actuator means for each pop-up member is a manually-openable and closable release door 90, 92, 94. Each release door has a doorknob portion thereon 96, 98, 100. Again, the structural and functional details of only one release door, i.e. representative release door 92 will be discussed herein.

The release door 92 has a camming element 102*b* mounted thereon at its lower edge. As best shown in FIG. 3, the release door 92 and the camming element 102*b* are mounted on the housing 12 for joint swinging movement between an end-limiting closed position (FIG. 4) in which the camming element 102*b* engages the release extension 86 of the common actuator member 60 for securing the same in the latched position, and an end-limiting open position in which the camming element 102*b* is disengaged from the release extension 86 of the common actuator member 60. In the intermediate position shown in FIG. 3, the camming element 102*b* cammingly pushes against a raised camming surface 103 formed on the release extension 86 of the common actuator member 60. This pushing action by the camming element is directed along the opposite circumferential direction about the pivot axis, thereby unlatching the latching elements 70 to release the pop-up member 36.

In this manner, in response to the opening of the release door 92, the camming element 102*b* pushes the common actuator member 60 against the tension force of the return spring 74, thereby causing the latching elements 70 to move to their unlatched position. When the latching elements 70 move to their unlatched position, the biasing means 58 moves to its relaxed condition, which, in turn, causes the pop-up member 36 with its associated display 42 to move upwardly along its associated pair of tracks 48 into its display position. Thus, a child who successfully manipulates the doorknob 98, so as to open the door 92, is rewarded by seeing a fanciful picture.

In the preferred embodiment of this invention, there are three release doors 90, 92, 94, each having camming elements 102*a*, 102*b*, 102*c*, respectively. As best shown in FIG. 1, the release doors are framed by frame portions of the front wall 30 of the housing. The release doors are located at the open front end of each common actuator member 60 generally above the fourth edge of the rectangular base wall 62 in a generally vertical plane which is spaced parallel to the back wall 68. Each release door is pivotally mounted on the housing, and is swingable about a different axis.

For example, release door 90 is openable about a generally vertical axis towards the left in FIG. 1. Release door 94 is openable about a generally vertical axis towards the right in FIG. 1. Release door 92 is openable about a generally horizontal axis downwardly towards the viewer in FIG. 1. Further, each doorknob portion has a different geometrical shape: doorknob portions 96, 98, 100 are generally circular, triangular, and rectangular, respectively. In this manner, the child is provided with extra intellectual stimulation. Further, the child is encouraged to learn about different shapes and dimensions.

Additionally, the doorknobs 96, 98, 100 have access openings located at different portions of the doors. For example, the access opening 95 is located on the right side of the doorknob 96; the access opening 97 is located on the upper side of the doorknob 98; and the access opening 99 is located on the left side of the doorknob 100. The different locations for the access openings, in addition to their tiny size, cooperate to aid the child's development of his fine motor skills, and also contribute to the overall play value by providing the child with different play options. In short, the child learns the different manners in which the doors can be opened.

A third actuator means for each pop-up member consists of differently-shaped release weights or three-dimensional toy blocks 16, 18, 20 and a swingable striker means or hammer 14. As best seen in FIG. 1, the blocks are provided with a plurality of wedge-shaped ribs or friction-retention portions 104, 106, 108 at their respective peripheries. Further, the release blocks 16, 18, 20 have cross-sections which correspond to a set of differently-shaped cut-outs 110, 112, 114 formed on the overhead housing portion 28, so as to pass therethrough. Each release block is capable of passing through only one of the cut-outs due to their respective shapes.

As best shown in FIG. 4, when the representative release block 16 is inserted into the appropriate cut-out portion 110, the block 16 is retained in a partially-inserted position due to frictional engagement by the wedge-shaped ribs. Put another way, the ribs 104 cause an interference fit so as to retain the block 16 in the cutout 110 without falling therethrough under the influence of gravity.

A child may either manually push downwardly upon the partially-inserted and held release block 16, or strike the partially-inserted release block with the hammer 14. In either event, the release block 14 is thereby propelled downwardly, and impacts upon the base wall 62 of the common actuator member 60 with a force proportionate to the striking blow. When the block 16 impacts upon the base wall 62, it causes the actuator member 60 to move in the aforementioned reverse circumferential direction against the tension force of the return spring 74. This then causes the latching elements 70 to move to their unlatched position, thereby enabling the biasing means 58 to move to its relaxed condition. In turn, the biasing means 58, in moving to its relaxed condition, propels the pop-up member 34 with its display 40 to move to its display position. Thus, the child is rewarded by viewing a fanciful figure for properly propelling the release block 16.

Figure 5:
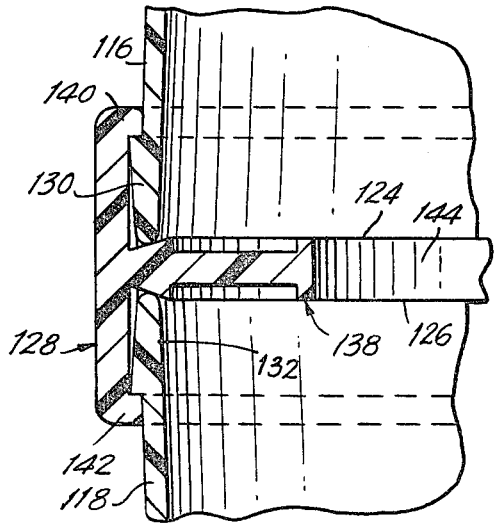
FIG. 5 is an enlarged cross-sectional, broken-away view of the hammer head taken along line 5—5 of FIG. 4.

As mentioned above, there are three differently-shaped release blocks and three differently-shaped cut-outs corresponding to the shapes of the release blocks. These shapes can be any geometrical shape, such as circular, triangular or rectangular. Thus, the child is provided with increased intellectual stimulation when he is compelled to match the blocks to the cutouts. Moreover, each doorknob has a corresponding shape to that of the block and associated cutout. This aids the child in retrieving the block by opening the appropriate door and removing the block from the associated actuator member. The striker or hammer 14, as best depicted in FIGS. 4 and 5, includes a pair of cup-shaped head elements 116, 118. Each cup-shaped head element 116, 118 has a closed end 120, 122, and an open end 124, 126. The hammer further has an annular ring 128 which serves as a locking ring to snappingly lock the head elements 116, 118 together to form a hammer head 134.

Each cup-shaped head element has an annular snap-type lip 130, 132 at its exterior surface at the open end thereof. The locking ring 128 has a pair of annular flanges 140, 142 which snappingly engage the lips 130, 132 when the lips are inserted, under pressure, into opposite axial ends of the locking ring. When fully inserted, the lips are spaced at a predetermined distance from each other due to the spacer disc 138 which is located between the opposite ends of the locking ring 128. A handle 136 is connected to the locking ring 128, and provides a handhold for the child to swing the hammer 14.

The cup-shaped head elements 116, 118 in the preferred embodiment are made of a rigid but slightly deformable, resilient plastic material so that they will distort slightly upon impact. By so constructing the hammer, the force of its impact is slightly lessened so that a child cannot accidently harm himself or another with the hammer. The force, however, remains great enough to propel the release weights 16, 18, 20 through the cut-outs 110, 112, 114, respectively.

Further, by constructing the hammer head 134 so that the head elements 116, 118 are slightly spaced apart, another means of lessening the impact force of the hammer 14 is provided. Similarly, an air passage 114 extends through the center of the disc 138 to permit air to flow from the interior of one head element to the interior of the other head element to also reduce the impact force by providing an air cushion.

The rear wall 32 of the housing 12 is dimensioned to extend a distance above the overhead portion 28, such that when the pop-up members 34, 36, 38 are in their display position, the pop-up members do not extend above the rear wall 32. In this manner, the rear wall 32 acts as a shield, thereby protecting the child from possible injury due to the sudden release movement of the pop-up members 34, 36, 38.

Of course, the hammer 114 can also be used to strike the extensions 84, 86, 88, rather than relying solely on manual depression, for actuating the pop-up members. This represents yet another versatile aspect of this toy.

As can be seen from all of the foregoing, the present invention provides a children's toy which overcomes the disadvantages of the prior art toys and further provides a child with an intellectually-stimulating toy which can be used for extended time periods without boredom.

It will be understood that each of the elements described above, or two or more together, may also find a useful application in other types of constructions differing from the types described above.

While the invention has been illustrated and described as embodied in an educational, action-type, amusement center toy for children, it is not to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An educational, action-type, amusement center toy for children, comprising:

(a) a housing;

(b) at least one pop-up member having display means mounted thereon;

(c) means for mounting said one pop-up member and its associated display means on the housing for joint movement along a path between
- a hidden position in which the display means is substantially hidden from a child's view, and
- a display position in which the display means is visible to the child;

(d) a plurality of different actuator means for moving said one pop-up member, each of said different actuator means being operative for moving said one pop-up member from its hidden position to its display position in response to different manual actions performed by the child;

(e) a common actuator member pivotally mounted on the housing for turning displacement about a pivot axis transversely of said path of said one pop-up member, said common actuator member having a latching element mounted thereon for joint displacement between a latched position in which the latching element extends into said path to retain said one pop-up member in its hidden position, and an unlatched position in which the latching element is located remotely from said path to unlatch said one pop-up member, each actuator means being operatively connected to the latching element for displacing the latching element from its latched position to its unlatched position; and (f) means for constantly urging said common actuator member in a predetermined circumferential direction about the pivot axis, each of said actuator means being operative for moving said common actuator member in the reverse circumferential direction opposite to said predetermined direction, whereby any one of the plurality of different actuator means can be selected by the child to move said one pop-up member to its display position.

2. The toy as defined in claim 1, wherein said toy comprises additional pop-up members each having display means mounted thereon, and each being mounted on the housing for movement between a hidden and a display position; and further comprising additional pluralities of different actuator means, each additional plurality being operative for moving a selected one of said additional pop-up members to its respective display position, each of said different actuator means of said additional pluralities being operative for moving its respective additional pop-up member from its hidden to its display position in response to different manual actions performed by the child.

3. The toy as defined in claim 1, wherein said housing has a generally upwardly-extending track, and wherein said one pop-up member is mounted for reciprocal sliding movement along the track.

4. The toy as defined in claim 3; and further comprising guide means for guiding said one pop-up member in its sliding movement along the track.

5. The toy as defined in claim 1, wherein said mounting means includes biasing means for constantly urging said one pop-up member towards its display position with a predetermined biasing force; and wherein each of said actuator means includes latching means for retaining said one pop-up member in its hidden position with a latching force having a magnitude greater than said biasing force, and wherein each of said actuator means further includes release means for unlatching said one pop-up member to permit said biasing means to move said one pop-up member towards its display position under the influence of said biasing force.

6. The toy as defined in claim 5, wherein said biasing means includes an elastomeric element having one end mounted on the housing, and its other end mounted on said one pop-up member; said elastomeric element being stretchable between a stressed and a relaxed condition when said one pop-up member is in its hidden and display positions, respectively.

7. The toy as defined in claim 1, wherein said one pop-up member has a recess, and wherein said latching element is a projection which is received with latching engagement within said recess when the latching element is in its latched position.

8. The toy as defined in claim 7, wherein said projection is tapered to facilitate its withdrawal from the recess when the latching element is displaced towards the unlatched position.

9. The toy as defined in claim 1; and further comprising means on said common actuator member for preventing unauthorized axial displacement of the latter when it is in said latched position.

10. The toy as defined in claim 1, wherein one of said actuator means includes a manually-depressable release extension extending radially from said common actuator member, and operative for displacing said common actuator member along said reverse direction to unlatch the latching element in response to manual depression downwardly on the release extension.

11. The toy as defined in claim 13, wherein said common actuator member has a generally rectangular base wall, and three side walls extending generally upwardly from the base wall along three edges of the same; and wherein said release extension is connected to, and extends radially from, the fourth edge of said base wall.

12. The toy as defined in claim 1, wherein one of said actuator means includes a manually-openable release door having a camming element mounted thereon, said release door and camming element being mounted on the housing for joint swinging movement between a closed position in which the camming element engages the common actuator member for securing the same in its latched position, and an open position in which the camming element is disengaged from the common actuator member; and wherein said camming element cammingly pushes said common actuator member along said reverse direction to unlatch the latching element during movement of the camming element between the open and closed positions in response to manual opening of the release door.

13. The toy as defined in claim 12, wherein said common actuator member has a generally rectangular base wall, and three side walls extending generally upwardly from the base wall along three edges of the same; and where said release door is located above, and extends generally upwardly of, the fourth edge of said base wall when said release door is in its closed position.

14. The toy as defined in claim 1, wherein one of said actuator means includes a release weight operative for displacing said common actuator member along said reverse direction to unlatch the latching element in response to overhead dropping of the release weight on the common actuator member.

15. The toy as defined in claim 14, wherein said common actuator member has a base wall, and wherein said release weight impacts against the base wall.

16. The toy as defined in claim 15, wherein said housing has an overhead portion which overlies the base wall of said common actuator member, said overhead portion having a cutout of complementary dimensions with that of the release weight to permit the latter to pass through the cutout and impact against the base wall.

17. The toy as defined in claim 16, wherein said release weight has friction-retention means for frictionally holding the release weight in the cutout without falling therethrough under the influence of the force of gravity; and wherein said one actuator means includes striker means for striking the held release weight to propel the same through the cutout and against the base wall of the common actuator member.

18. The toy as defined in claim 17, wherein said striker means includes a pair of cup-shaped elements each having a closed end and an open end; a locking ring for locking the head elements together to form a hammer head, said locking ring surrounding each open end of the head elements; and a handle operatively connected to the hammer head for providing a handhold for the child to swing the striker means to actuate at least one of the acutator means.

19. The toy as defined in claim 18, wherein each head element has an annular snap-type lip surrounding its respective open end; and wherein said locking ring includes means for spacing the two head elements at a predetermined distance apart from each other, and means for snappingly engaging each lip when the head elements are spaced at said predetermined distance.

20. The toy as defined in claim 1, wherein said display means is a sheet element having a fancifully-arranged picture applied thereon.

21. The toy as defined in claim 1, wherein said toy includes a pair of pop-up members each having display means mounted thereon and mounted on the housing for joint movement between a hidden and a display position; a first and a second plurality of different actuator means each said different actuator means operative for independently moving the pop-up members from their respective hidden positions to their respective display positions.

22. The toy as defined in claim 1; and further comprising handle means for transporting the toy from place to place.

23. The toy as defined in claim 1, wherein said housing has a rear shield wall closely adjacent said one pop-up member throughout the entire movement of the latter, for protecting children from possible injury when said one pop-up member moves to its display position.

24. An educational, action-type, amusement center toy for children, comprising:

(a) a housing;

(b) a pair of pop-up members each having display means mounted thereon;

(c) means for mounting said pop-up members and their associated display means on the housing for joint movement along a path between
- a hidden position in which each display means is substantially hidden from a child's view, and
- a display position in which each display means is visible to the child;

(d) a first and a second plurality of different actuator means for respectively moving said pop-up members, each of said different actuator means being operative for independently moving said pop-up members from their respective hidden positions to their respective display positions in response to different manual actions performed by the child;

(e) a common actuator member for each plurality of actuator means, each common actuator member being mounted on the housing for displacement between a latched position in which the respective pop-up member is retained in its hidden position, and an unlatched position in which the respective pop-up member is unlatched to permit movement towards its display position; and (f) each of said pluralities of actuator means including a manually-operable release door mounted on the housing for swinging movement between a closed position in which the common actuator member is retained in its latched position, and an open position in which the common actuator member is displaced to its unlatched position, each release door being swingable about a different axis in response to manual opening of the release doors, whereby any one of the first and second plurality of different actuator means can be selected by the child to respectively move said pop-up members to their display positions.

25. The toy as defined in claim 24, wherein each release door has a doorknob portion at a different location on the release door.

26. The toy as defined in claim 25, wherein each doorknob portion has a different configuration.

27. An educational, action-type, amusement center toy for children, comprising:

(a) a housing having an overhead portion with different cutouts of different shapes;
(b) a pair of pop-up members each having display means mounted thereon;
(c) means for mounting said pop-up members and their associated display means on the housing for joint movement along a path between
a hidden position in which each display means is substantially hidden from a child's view, and
a display position in which each display means is visible to the child;
(d) a first and a second plurality of different actuator means for respectively moving said pop-up members, each of said different actuator means being operative for independently moving said pop-up members from their respective hidden positions to their respective display positions in response to different manual actions performed by the child;
(e) a common actuator member for each plurality of actuator means, each common actuator member being mounted on the housing for displacement between a latched position in which the respective pop-up member is retained in its hidden position, and an unlatched position in which the respective pop-up member is unlatched to permit movement towards its display position; and
(f) said pluralities of actuator means including a pair of release weights operative for displacing their respective actuator member to its unlatched position in response to overhead dropping of the release weights on the respective actuator member, said release weights being of different shapes and being configured to be of complementary contour with the different cutouts to permit each release weight to pass through only one of the cutouts and impact against the associated actuator member,
whereby any one of the first and second plurality of different actuator means can be selected by the child to respectively move said pop-up members to their display positions.

28. The toy as defined in claim 27, wherein each release weight has friction-retention means for frictionally holding the release weights in their respective cutouts without falling therethrough under the influence of gravity; and further comprising striker means for striking the held release weights to propel the same through the cutouts and against the actuator members.

29. An educational, action-type, amusement center toy for children, comprising:
(a) a housing;
(b) a trio of pop-up members each having display means mounted thereon;
(c) means for mounting said pop-up members and their associated display means on the housing for joint movement along a path between
a hidden position in which each display means is substantially hidden from a child's view, and
a display position in which each display means is visible to the child;
(d) a first, a second, and a third plurality of different actuator means for respectively moving said pop-up members, each of said different actuator means being operative for independently moving said pop-up members from their respective hidden positions to their respective display positions in response to different manual actions performed by the child;
(e) a common actuator member for each plurality of actuator means, each common actuator member being mounted on the housing for displacement between a latched position in which the respective pop-up member is retained in its hidden position, and an unlatched position in which the respective pop-up member is unlatched to permit movement towards its display position; and
(f) each of said pluralities of actuator means including a manually-openable release door mounted on the housing for swinging movement between a closed and an open position, each release door being swingable about a different axis,
whereby any one of the first, second and third plurality of different actuator means can be selected by the child to respectively move said pop-up members to their display positions.

30. The toy as defined in claim 29, wherein said housing has an overhead portion which overlies each actuator member, said overhead portion having three different cutouts of different dimensions, and wherein each one of said pluralities of actuator means includes a set of three release weights operative for displacing their respective actuator member, said release weights being of different shapes and configured to be of complementary contour with the different cutouts to permit passage of each release weight through only one of said cutouts; and wherein each release door has a doorknob portion which is shaped with a configuration corresponding to the shapes of said cutouts and associated release weights.

31. The toy as defined in claim 29, wherein the release doors of said pluralities are openable about horizontal and vertical axes.

32. An educational, action-type, amusement center toy for children, comprising:
(a) a housing having an overhead portion with three different cutouts of different shapes;
(b) a pair of pop-up members each having display means mounted thereon;
(c) means for mounting said pop-up members and their associated display means on the housing for joint movement along a path between
a hidden position in which each display means is substantially hidden from a child's view, and
a display position in which each display means is visible to the child;
(d) a first and a second plurality of different actuator means for respectively moving said pop-up members, each of said different actuator means being operative for independently moving said pop-up members from their respective hidden positions to their respective display positions in response to different manual actions performed by the child;
(e) a common actuator member for each plurality of actuator means, each common actuator member being mounted on the housing for displacement between a latched position in which the respective pop-up member is retained in its hidden position, and an unlatched position in which the respective pop-up member is unlatched to permit movement towards its display position; and
(f) said pluralities of actuator means including a set of three release weights operative for displacing their respective actuator member, said release weights being of different shapes and configured to be of complementary contour with the different cutouts to permit passage of each release weight through only one of said cutouts, whereby any one of the first and second plurality of different actuator means can be selected by the child to respectively move said pop-up members to their display positions.

33. The toy as defined in claim 32, wherein said cutouts and release weights have a circular, triangular, and rectangular cross-section.

* * * * *